US007775320B2

(12) United States Patent
McCain et al.

(10) Patent No.: US 7,775,320 B2
(45) Date of Patent: Aug. 17, 2010

(54) METHOD FOR REDUCING NOISE IN A VEHICLE CABIN

(75) Inventors: Daniel McCain, Hilliard, OH (US); Hajime Igami, Dublin, OH (US); Yoshiyuki Hayashi, Knoxville, OH (US); Toshio Inoue, Shioya-gun (JP); Kosuke Sakamoto, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 194 days.

(21) Appl. No.: 12/052,385

(22) Filed: Mar. 20, 2008

(65) Prior Publication Data

US 2009/0236173 A1 Sep. 24, 2009

(51) Int. Cl.
*F01N 1/06* (2006.01)

(52) U.S. Cl. ..... 181/206; 181/175; 381/71.1; 381/71.4; 381/71.8

(58) Field of Classification Search ..... 181/206, 181/175; 381/71.1, 71.4, 71.8
See application file for complete search history.

(56) References Cited

U.S. PATENT DOCUMENTS 5,445,517 A * 8/1995 Kondou et al. ..... 431/18
5,581,619 A * 12/1996 Shibata et al. ..... 381/71.4
6,588,392 B2 * 7/2003 Armstrong et al. ..... 123/192.1
7,350,499 B2 * 4/2008 Takaoka et al. ..... 123/198 F
7,536,018 B2 * 5/2009 Onishi et al. ..... 381/71.8
2003/0079937 A1 * 5/2003 Vaishya ..... 181/206
2004/0258251 A1 12/2004 Inoue et al.
2009/0208025 A1 * 8/2009 Hayashi et al. ..... 381/71.4

* cited by examiner

*Primary Examiner*—Jeffrey Donels
*Assistant Examiner*—Forrest M Phillips
(74) *Attorney, Agent, or Firm*—Mark E. Duell; Rankin, Hill & Clark LLP

(57) ABSTRACT

A method of controlling noise from a six cylinder engine that can selectively use in separate operating modes either three cylinders, four cylinders, or all six cylinders, is provided that uses a noise cancellation system to provide a cancellation sound at a first frequency representative of the engine operating mode. When the vehicle changes, for example, from a three cylinder utilization mode to six cylinder utilization mode, the method extends the provision of the noise cancellation sound, at a frequency representative of three cylinder operation, beyond the time when three cylinder mode is changed to six cylinder mode. As a result, a residual "pop" noise associated with the vehicle exhaust, that is traditionally heard during the transition period is cancelled and no longer noticeable. The method also includes implementation of a waiting time before a providing cancellation sounds of different frequencies, to avoid amplitude mismatch.

14 Claims, 11 Drawing Sheets

| Description | Time Delay |
|---|---|
| Controls 6→3 Cylinder Kick-In Delay | 2 ms |
| Controls 6→4 Cylinder Kick-In Delay | 2 ms |
| Controls 3→6 Cylinder Kick-Out Delay | 600 ms |
| Controls 3→4 Cylinder Switching Delay | 2 ms |
| Controls 4→6 Cylinder Kick-Out Delay | 200 ms |
| Controls 4→3 Cylinder Switching Delay | 2 ms |
| Waiting Time | 55 ms |

Fig. 10

METHOD FOR REDUCING NOISE IN A VEHICLE CABIN

BACKGROUND OF THE INVENTION

Improving fuel efficiency is becoming more and more important in modern automobiles. In this field there has been an age-old tradeoff between fuel efficiency and vehicle power. For example, a four cylinder engine placed within a vehicle typically provides a fuel efficient vehicle lacking substantial power, while a six or eight cylinder engine provides plenty of power, but not a vehicle that is overly fuel efficient.

One way in which this tradeoff has been resolved is to provide a vehicle in which some of the engine cylinders are used selectively (i.e. Cylinder De-activation). For example, in situations where maximum power is required the engine, which is constructed with eight cylinders or six cylinders depending on the engine type, utilizes all six or eight cylinders. However, when power requirements are small, the vehicle utilizes only three or four of the cylinders, and as a result fuel efficiency of the vehicle is increased significantly.

Several vehicle characteristics need to be addressed, however, when there is a change in the number of engine cylinders utilized. Aspects such as engine fuel distribution, heat distribution/dissipation and engine vibration patterns change. Vehicle noises also change, being different in each engine operating mode and also during a transition period when one mode changes to another mode.

What is desired is a way to minimize vehicle noise caused during a transition period when the number of engine cylinders being utilized is changed.

BRIEF SUMMARY OF THE INVENTION

The present invention overcomes drawbacks in the prior art by providing an improved method for reducing noise in a vehicle cabin. The method includes the steps of providing a controllable six cylinder engine that can selectively use, in separate operating modes, either three cylinders, four cylinders, or all six cylinders, and providing a noise cancellation system including logic for estimating the frequency and amplitude of the offensive cabin noise. The system begins with an initial estimated cancellation signal and then uses microphones placed in the vehicle cabin to detect the actual offensive noise and modify the cancellation signal to more accurately cancel the actual noise. Speakers located in the vehicle cabin output the cancellation signal as a cancelling sound.

When the vehicle changes, for example, from a three cylinder utilization mode to six cylinder utilization mode, the method extends the provision of the noise cancelling sound, at a frequency representative of three cylinder operation, beyond the time when three cylinder mode is changed to six cylinder mode. This is different than common practices. As a result, an exhaust-related "pop" noise that is traditionally heard during the transition period is cancelled to such a degree that it is no longer noticeable. The cancelling sound is then changed to be representative of the six cylinder frequency. The period of extension is referred to as a delay time, because beginning the provision of the cancelling sound at the frequency representative of the later operating mode is delayed.

In a change of modes where the cancelling sound changes from a large required amplitude (for example in a three cylinder operating mode) to a small required amplitude (for example in a six cylinder operating mode), the method adjusts the delay time and also adds a waiting time such that the vehicle speakers will not initially output a cancelling sound (in the six cylinder mode) with an amplitude greater than the offensive engine noise, which will occur if changeover occurs to quickly, and will be disturbing the vehicle occupants.

These and other aspects of the invention are described below with reference to the figures.

BRIEF DESCRIPTION OF THE DRAWINGS

FIG. 10 is a chart showing preferred delay times for different cylinder utilization changes;

DETAILED DESCRIPTION OF THE INVENTION

As described in more detail below, a method is provided for minimizing vehicle noise when a vehicle utilizing Cylinder De-Activation changes from a smaller number of cylinders utilized to a larger number of cylinders utilized or vise-versa, that includes extending the provision of cancellation sound of a first order for a fixed period of time after changing cylinder utilization modes.

Figure 1:
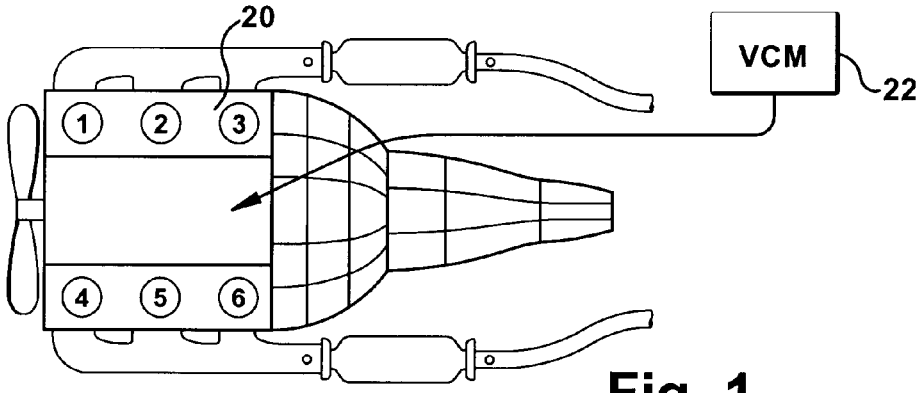
FIG. 1 is a schematic of a six cylinder vehicle engine.

Referring to FIG. 1, a six cylinder engine 20 in a common V-arrangement (V6), as is used in a typical vehicle, is shown. The engine is controlled with a system called Variable Cylinder Management (VCM) 22. Using this system, the vehicle can run on six, four or three cylinders depending on the road speed and load conditions. When using VCM 22, during start-up, acceleration or when climbing hills, the engine 20 operates on all six cylinders. During moderate speed cruising and at low engine loads, the system operates just one bank of three engine cylinders. For moderate acceleration, higher-speed cruising and mild hills, the engine 20 operates on four cylinders. The VCM system 22 automatically closes both the intake and exhaust valves of the cylinders that are not used. At the same time the powertrain control module cuts fuel to those cylinders.

When operating on only three cylinders, the rear cylinder bank (cylinders 1, 2, and 3) is shut down. When running on four cylinders, typically the left and center cylinders of the front bank operate, and the right and center cylinders of the rear bank operate. Deactivation of cylinders is achieved by releasing a synchroniser pin that normally interlocks the cam follower and rocker arms. The synchroniser pin is released using hydraulic pressure which is controlled by a dedicated solenoid. Once the synchroniser pin is released, the cam follower continues to move against the camshaft but the rocker arms and valves remain in a closed position.

Figure 2:
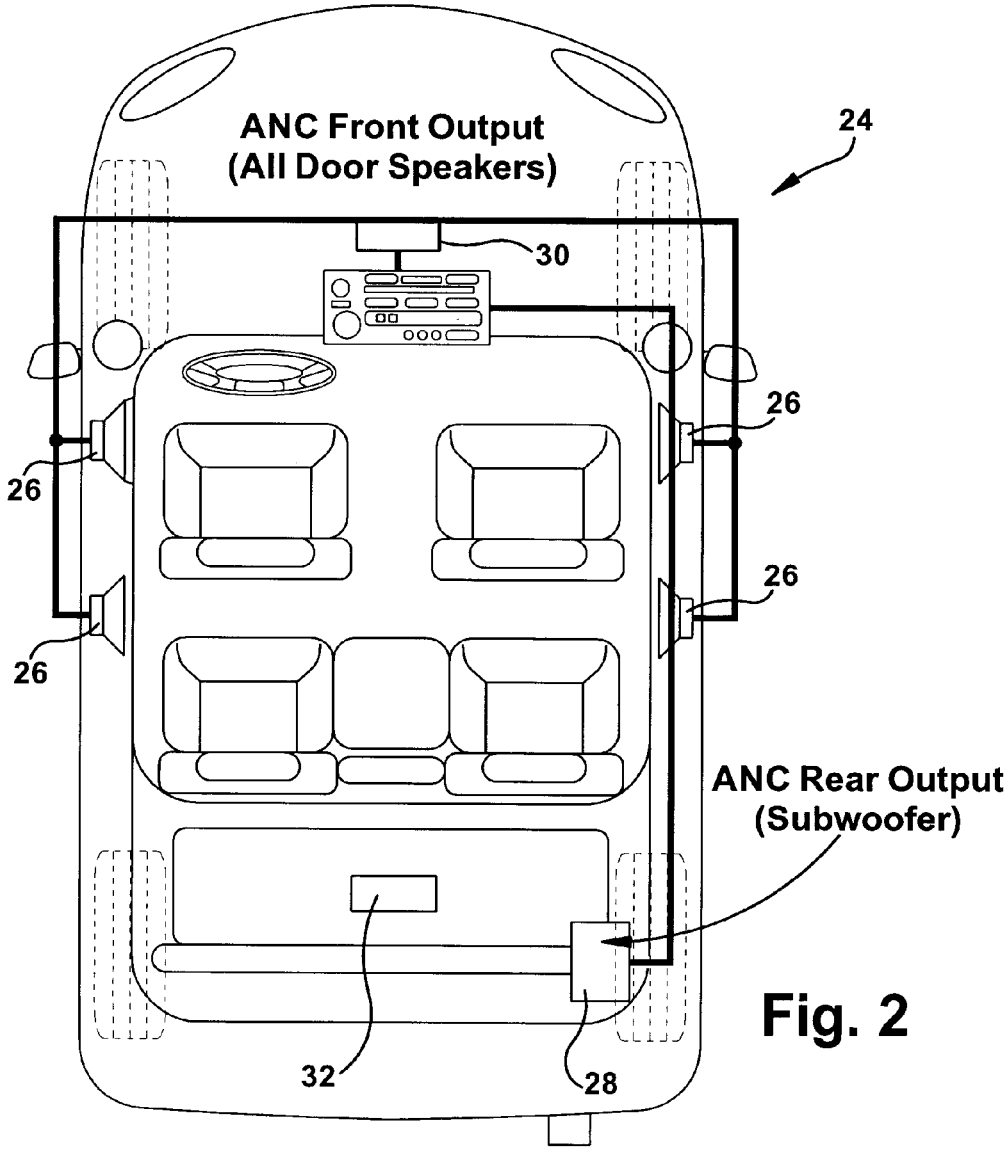
FIG. 2 is a schematic top view of a vehicle showing microphone and speaker locations therein.

Referring to FIG. 2, in order to minimize noise associated with VCM 22, an Active Noise Control (ANC) system 24 is also used in the vehicle. As described in more detail below, the vehicle's audio system speakers 26 and 28 cancel undesirable engine boom, especially during three cylinder operation. Engine boom is a vibration-based noise caused by moving engine parts and is transferred to the vehicle cabin via the crankshaft and through the engine mounts. As described in more detail below, characteristics (frequency, etc.) of this boom can be estimated and an out-of-phase cancelling signal generated in the ANC 24.

In general, the engine generates more noise requiring cancellation when fewer cylinders are utilized. For example, when six cylinders are used, a particular frequency of noise is generated and many of the vehicle's typical noise absorbing devices (engine mounts, insulation, etc) are tuned to eliminate noise of this frequency. When fewer cylinders are used, noise of a different frequency is generated and these traditional absorbers are less effective, thus, ANC plays a greater role. Consequently, in the partial-cylinder operation mode, an ANC cancellation signal (and generated sound) will have a relatively higher amplitude than in a full-cylinder operation mode.

Two microphones 30 and 32 located within the vehicle cabin (one in front 30 and one in rear 32) sense the specific characteristics of the engine boom noise within the cabin. The ANC 24 then modifies the out of phase cancellation signal based on the sensed characteristics to better cancel out the offensive sounds waves. The signal is emitted as a cancellation sound from the door speakers 26 and the rear subwoofer 28.

Figure 3:
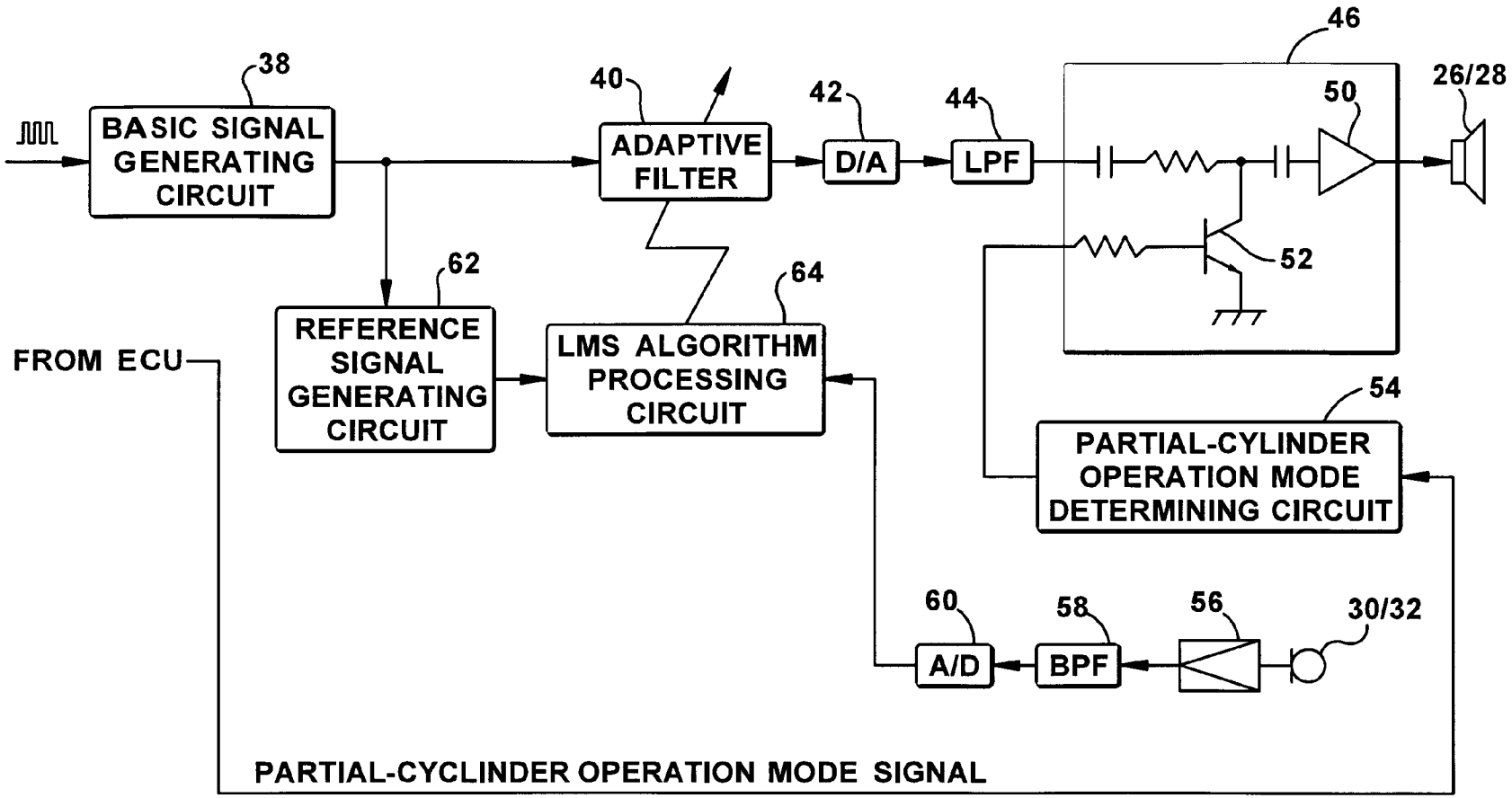
FIG. 3 is a flowchart showing an active noise control system.

Referring to FIG. 3, in a feed-forward manner the rotation of the output shaft of the internal combustion engine is detected by a sensor, and an output signal from the sensor is supplied to the basic signal generating circuit 38, which generates a basic signal that is a digital signal synchronous with vibratory noise produced by the vibratory noise source and having a frequency selected from the frequencies of vibratory noise generated by the vibratory noise source, i.e., a basic signal synchronous with the rotation of the output shaft and having a frequency depending on the frequency of the rotational 1.5th-order component. This noise component is defined as the sounds heard when there are 3 combustion events (one for each cylinder) during two rotations of the crankshaft (3 divided by 2 equals $1.5^{th}$ order).

There are also $3^{rd}$ order components (loudest during 6 cylinder operation) and negligible during other operating modes, and first order components (loudest during four cylinder operation) and negligible during other operating modes. Each order corresponds to a sound frequency depending on the engine operating speed (Frequency=Engine RPM/60× order). Thus when the engine operates at 1500 rpm, $1.5^{th}$ order noise occurs at 37.5 Hz and $3^{rd}$ order noise occurs at 75 Hz.

The basic signal is supplied to the adaptive filter 40, which processes the basic signal and outputs a canceling signal for canceling the vibratory noise in the passenger cabin. The canceling signal is converted by the D/A converter 42 into an analog canceling signal, which is filtered by a low-pass filter 44. The canceling signal is then amplified by the amplifying circuit 46 and supplied to the speakers 26 and 28 which serve as a canceling sound generating means in the passenger compartment.

The amplifying circuit comprises an amplifier 50 for amplifying the canceling signal output from the low-pass filter 44, and a transistor 52 as a switching control means for selectively grounding the input terminal of the amplifier to cut off the input signal applied to the amplifier 50.

A partial-cylinder operation mode signal output from the VCM 22 is delivered to the partial-cylinder operation mode determining circuit 54. The partial-cylinder operation mode determining circuit applies a decision signal indicative of the determined operation mode to the base of the transistor 52. Specifically, when the partial-cylinder operation mode determining circuit 54 applies a signal indicative of the full-cylinder operation mode to turn on the transistor 52, the input terminal of the amplifier is grounded thereby to shut off the amplifying circuit, de-energizing the active vibratory noise control apparatus. When the partial-cylinder operation mode determining circuit 54 applies a signal indicative of the partial-cylinder operation mode to turn off the transistor 52, the input terminal of the amplifier is disconnected from ground thereby to make the amplifying circuit active, energizing the active vibratory noise control apparatus.

The microphones 30 and 32 located in the passenger compartment detect the vibratory noise in the passenger compartment, and produce an error signal representative of the vibratory noise. The error signal output from the microphones 30 and 32 is amplified by the amplifying circuit 56, limited in band by the bandpass filter 58, and then converted into a digital error signal by the A/D converter 60.

The reference signal generating circuit 62 corrects the basic signal from the basic signal generating circuit 38 based on corrective data depending on signal transfer characteristics which include signal transfer characteristics of the speakers and the microphones and range between the speakers and the microphones in the passenger compartment, thereby generating a reference signal.

The LMS algorithm processing circuit 64, which corresponds to a filter coefficient updating means, performs LMS algorithm calculations based on the reference signal and the digital error signal to determine filter coefficients for minimizing the error signal, sequentially updates the filter coefficients of the adaptive filter 40 into the determined filter coefficients. The amplifying circuit 46 amplifies the canceling signal from the adaptive filter, and the speakers 48 convert the canceling signal into a canceling sound to cancel the vibratory noise in the passenger compartment. The decibel level of the sound is generally proportional to the voltage level of the signal. This operation is further described in U.S. Publication 2004/0258251 which is incorporated in its entirety by reference herein.

Operation of the method of the present invention is first described in a three cylinder to six cylinder operating mode changeover. Later, other changeover modes are also described.

Until now, an ANC $1.5^{th}$ order cancellation signal has not been used during six cylinder operation. Instead, only a $3^{rd}$ order cancellation signal (or no signal at certain engine rpms) was used in six cylinder operation mode. However, recent testing has determined that an offensive $1.5^{th}$ order exhaust-associated noise is generated just after the changeover from a three cylinder utilization mode to a six cylinder utilization mode.

As opposed to the engine boom transferred through the crank shaft and engine mounts, this added noise is transferred through the exhaust system to the cabin after a changeover of cylinder operating mode is completed. This exhaust-associated noise has a frequency ($1.5^{th}$ order) similar to the previously cancelled crankshaft/engine mount transmitted noise and is also picked up through the cabin microphones 30 and 32. The actual changeover time from lesser to more cylinders or vise-versa is approximately. 0.01-0.03 secs. In this time period, new engine/crankshaft noise is not being created. The "pop" noise generally occurs at about 0.1 to 0.2 seconds after changeover.

Figure 4:
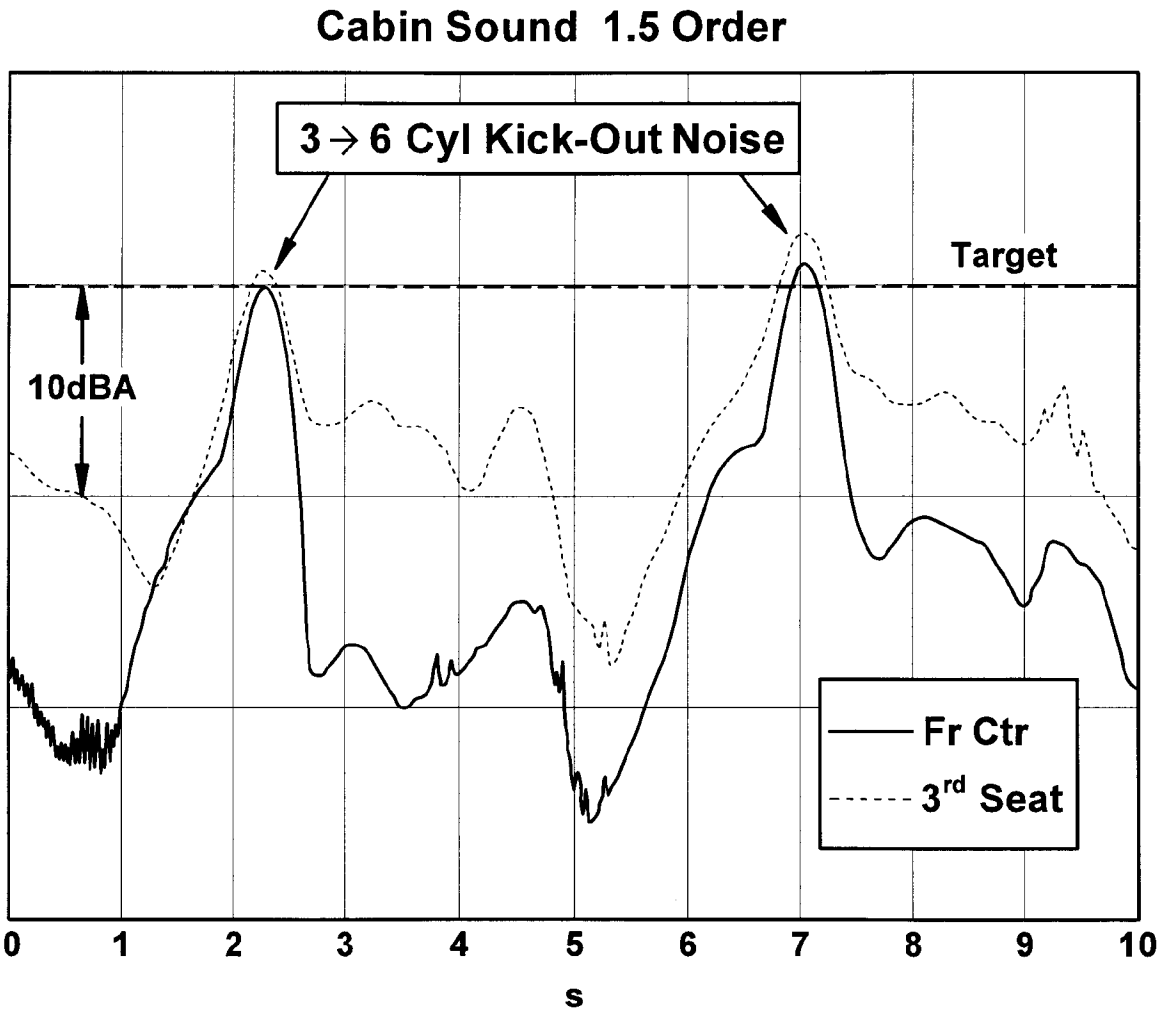
FIG. 4 is a graph showing an objectionable "pop" noise that occurs during a change in cylinder utilization mode.
Figure 5:
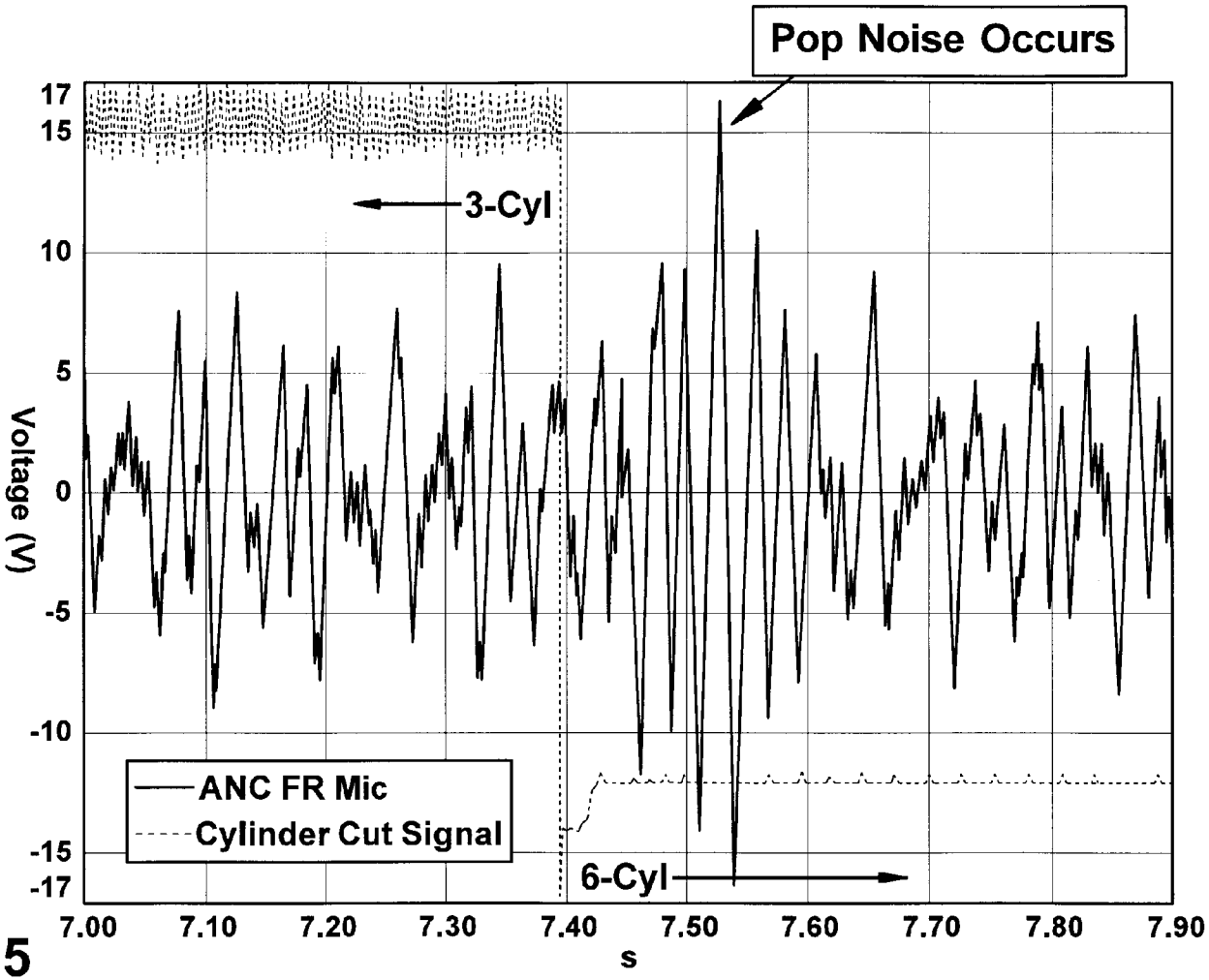
FIG. 5 is a graph showing in detail the time when the "pop" noise occurs in comparison to the time when the cylinder mode is changed.
Figure 6:
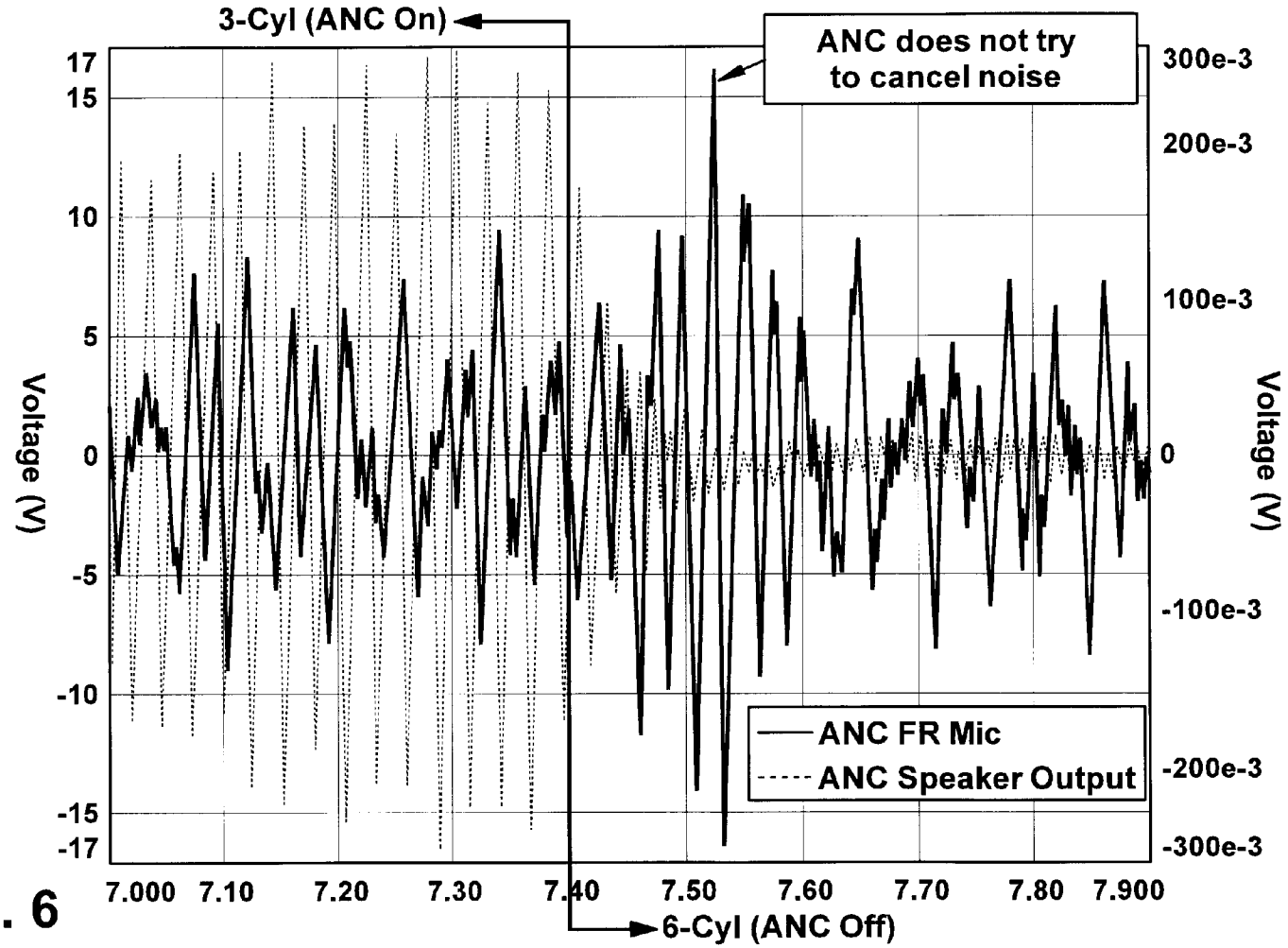
FIG. 6 is a graph showing how, in traditional practice, the "pop" noise is not cancelled.

Referring to FIGS. 4-6, graphs of noise (shown as a signal in volts, which is generally proportional to decibels) versus time are shown that include cylinder utilization mode change over events during the illustrated time periods. FIG. 4 shows two changeover events where a "pop" noise exceeding a target decibel threshold is generated after changeover. The noise is picked up by both the front microphone (solid line) and rear microphone (broken line). Specifically, referring to FIG. 5, at approximately 100-200 milliseconds after changeover, the exhaust-associated "pop" is heard within the vehicle cabin. The changeover event is shown by the severe vertical drop in the broken line and the "pop" is shown by the increased amplitude of the solid line. This "pop" sound is offensive to the vehicle occupants. However, because the $1.5^{th}$ order ANC cancellation signal traditionally is shut off immediately at changeover, this $1.5^{th}$ order "pop" sound is not cancelled in any manner. FIG. 6 illustrates the noise read by the front microphone (solid line) in comparison with the cancellation sound emitted from the front door speakers (broken line). The shrinking amplitude of the speaker line, beginning at the mode changeover, shows how the $1.5^{th}$ order ANC signal (and generated sound) is shut off before the "pop" occurs.

If the different order cancellation sound is not discontinued relatively quickly after changeover, and the source of the $1.5^{th}$ order noise is discontinued, the remaining out of phase cancellation sound will in time become offensive to the vehicle cabin occupants. Thus, traditionally the ANC has been either turned completely off or changed immediately to a $3^{rd}$ order cancellation signal. However, if use of the $1.5^{th}$ order cancellation signal is extended for just a short period of time, the cancellation sound does not become offensive. Thus, uniquely in the present invention, the $1.5^{th}$ order cancellation signal (and cancellation sound) is extended for a short, fixed period of time (delay time) to reduce the offensiveness of the exhaust-associated "pop" that is generated during the transition period.

Figure 7:
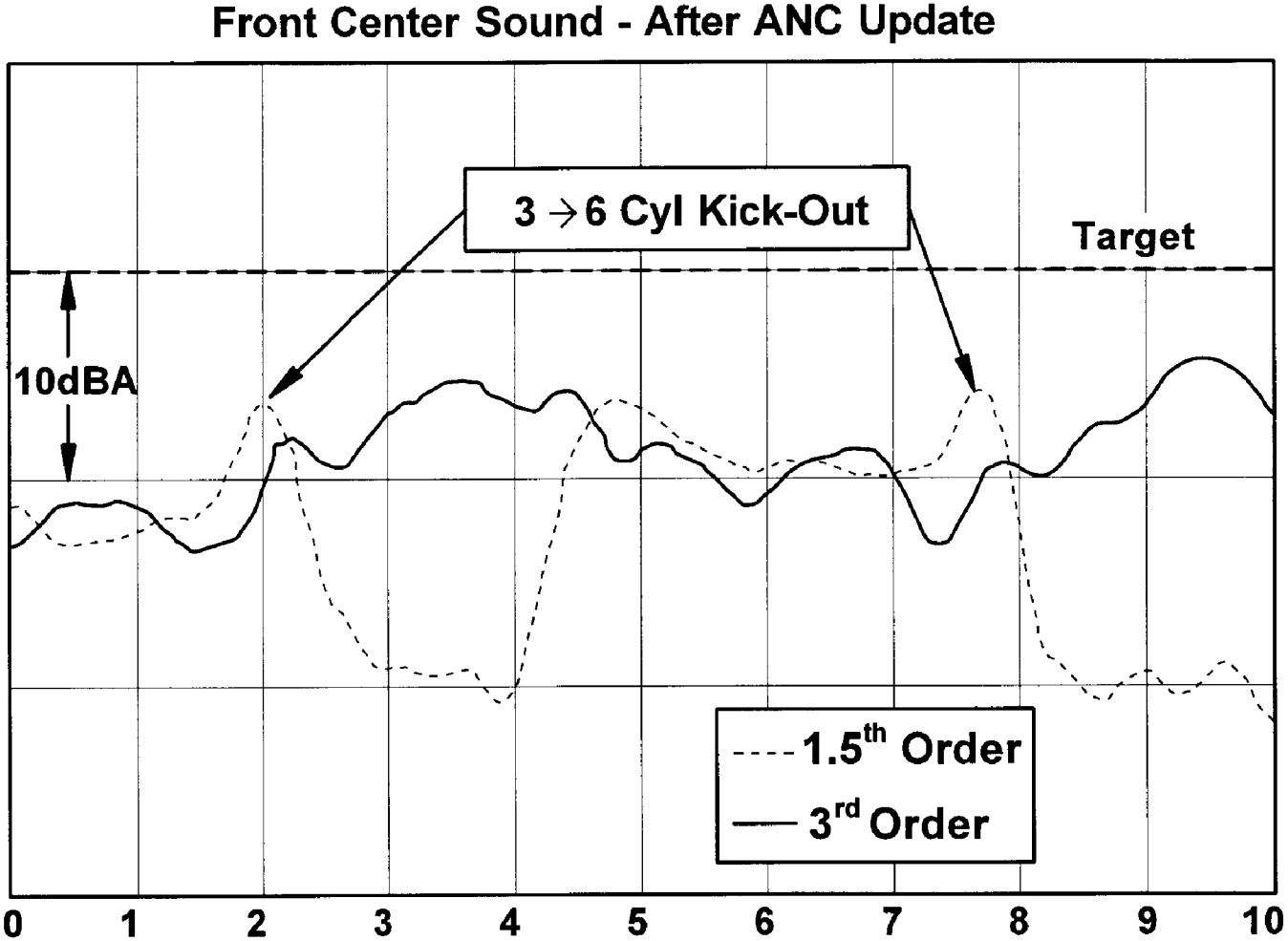
FIG. 7 is a graph showing how the "pop" noise is reduced by the method of the present invention.
Figure 8:
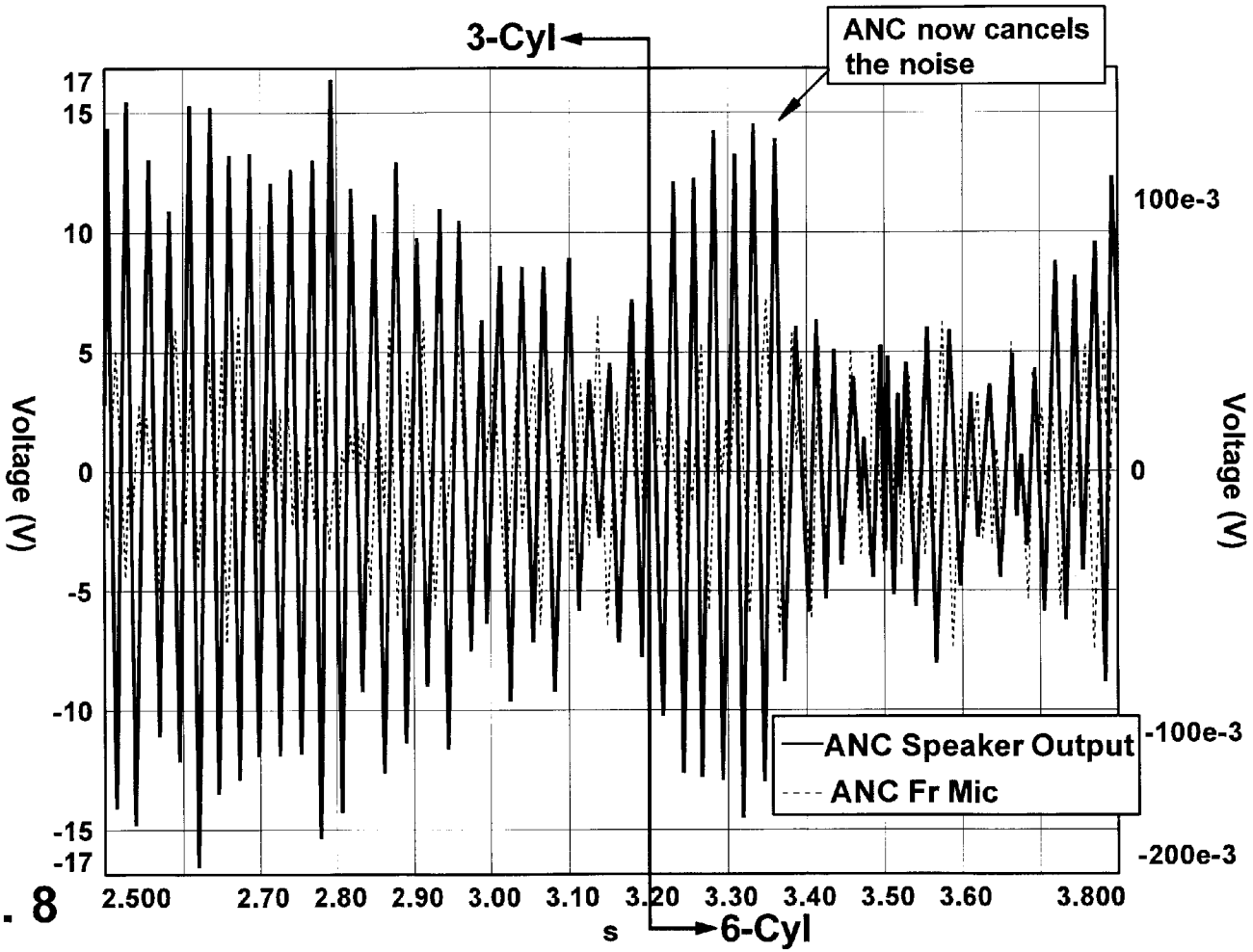
FIG. 8 is a detailed graph showing cancellation of the "pop" noise.
Figure 9:
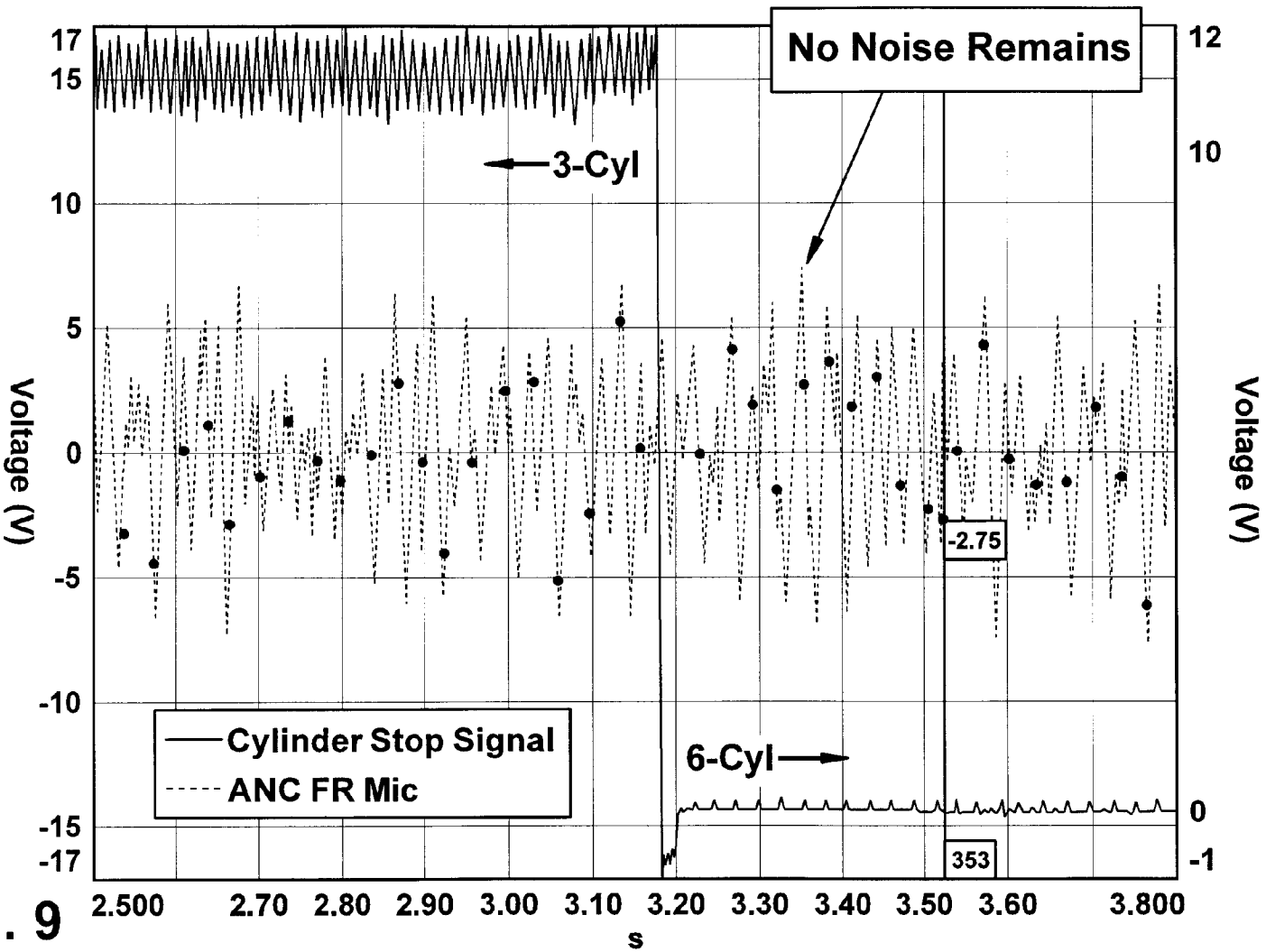
FIG. 9 is a detailed graph showing the results of cancellation of the "pop" noise.

Referring to FIGS. 7-9, application and results of a method of extending the cancellation signal (and sound) are shown. FIG. 7 shows a reduction corresponding to between 5-10 dbA (compared to FIG. 3) as read by both the front (solid line) and rear (broken line) vehicle cabin microphones. FIG. 8 shows an extension of the cancellation signal for a "delay time" of approximately 150 milliseconds. The solid line shows the cancellation sound emitted from the front speakers in the vehicle cabin. The broken line shows the resultant sound that is sensed by the front microphone. The "pop" noise has been reduced to a non-detectable level. FIG. 9 shows specifically that the pop noise is no longer detected by the front microphone.

If the engine is transitioning from a lesser cylinder utilization mode to a greater cylinder utilization mode, the "delay time" is termed a kick-out delay, and is of the type described in detail above. If the engine is transitioning from a greater to lesser cylinder utilization mode, the time delay is termed kick-in delay. FIG. 10 shows the preferred delay times associated with six different cylinder mode transitions.

Figure 11:
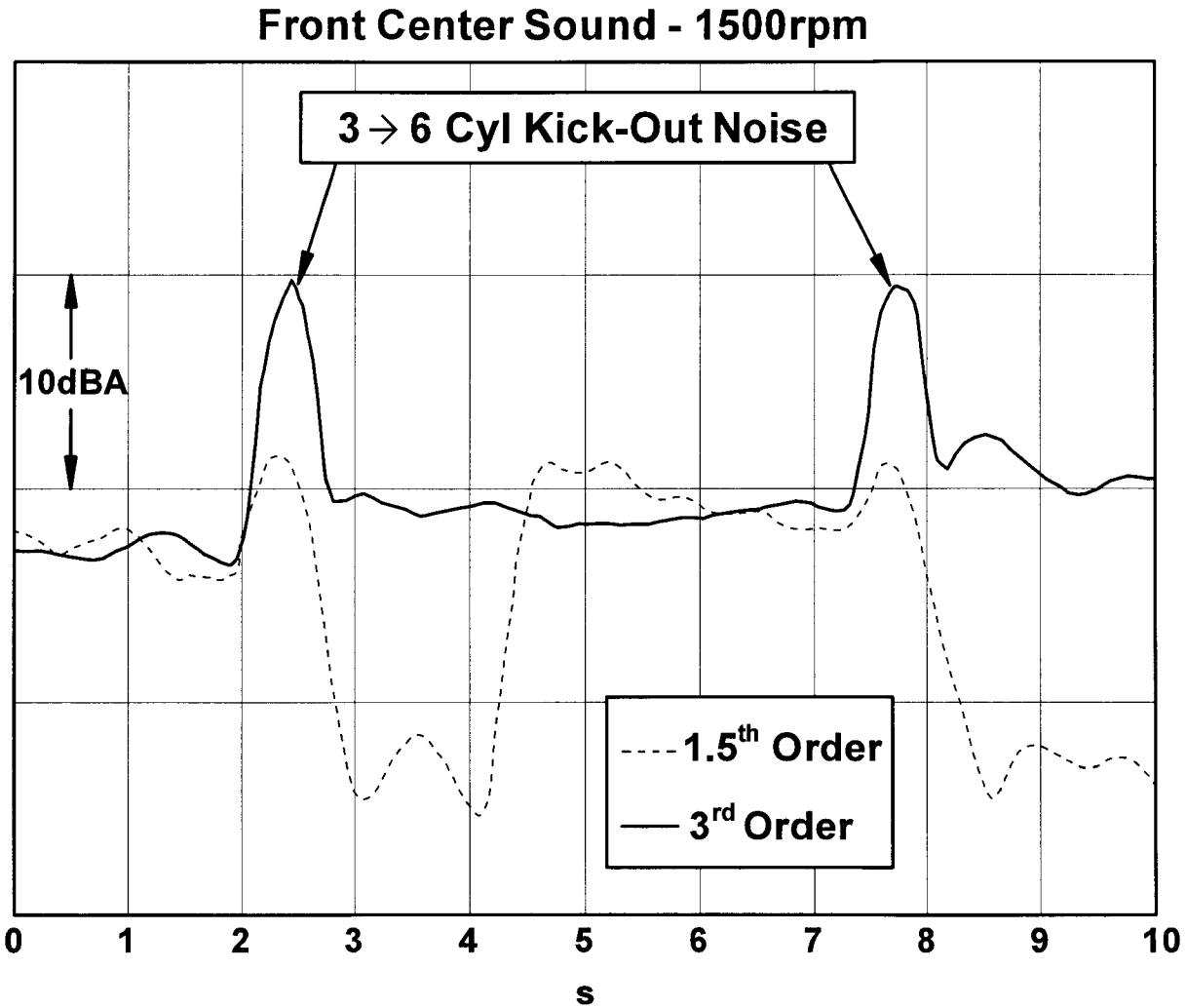
FIG. 11 is a graph showing a potential noise problem when a waiting time is not implemented.

FIGS. 11-12 again show a typical kick out delay scenario in a change from a three cylinder utilization mode to a six cylinder utilization mode showing measured noise of both $1.5^{th}$ order and $3^{rd}$ order.

The "waiting time" period is a short time period where the ANC cancellation signal is reduced before a changeover to a cancellation signal of a different order is completed. The waiting time period prevents a new cancellation sound with too high of an amplitude to be introduced into the vehicle cabin. As previously stated, noise cancellation is more necessary in modes when fewer cylinders are active. Thus referring to FIG. 11, if the waiting time period were eliminated and the ANC cancellation signal changed from $1.5^{th}$ order to $3^{rd}$ order immediately, the amplitude of the $3^{rd}$ order cancellation signal, initially, would be higher than the amplitude of the $3^{rd}$ order noise source. As a result the cancellation sound provided would be too loud and cause disturbance in the vehicle cabin. This is shown by a reading from the front microphone of $1.5^{th}$ order noise (broken line) and $3^{rd}$ order noise (solid line) in FIG. 11 ($3^{rd}$ order noise has increased peaks). By using the "waiting time" period, the amplitude of the $1.5^{th}$ order signal has a chance to drop to approximately zero and then the amplitude of the $3^{rd}$ order signal is ramped up from that level as quickly as possible.

Figure 12:
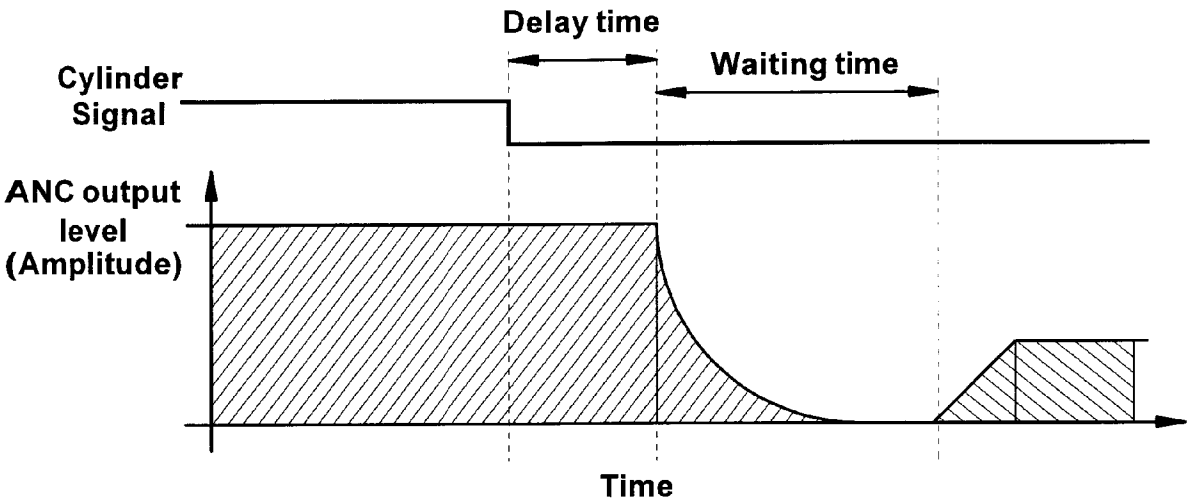
FIG. 12 is a schematic showing implementation of a delay time and waiting time during a changeover of cylinder utilization mode.

As shown in FIG. 12, the $1.5^{th}$ order ANC cancellation signal is extended, at a constant amplitude, past the time when the cylinder signal changes (first vertical broken line). The distance from the first broken vertical line to the second broken vertical line represents the "delay time" previously described. The delay time period is followed by a "waiting time" period (to the third vertical broken line).

Figure 13:
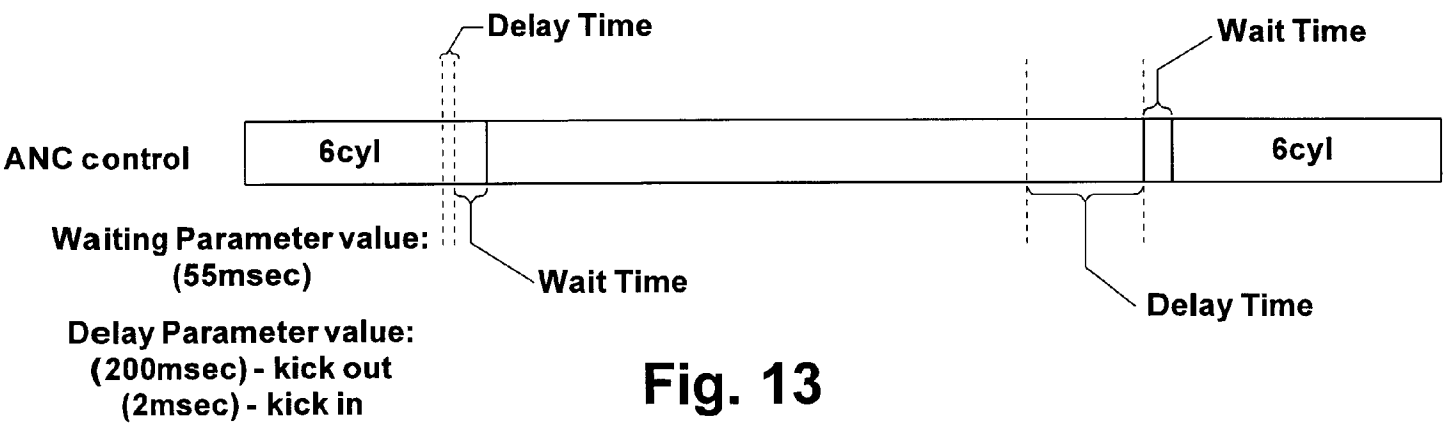
FIG. 13 is a schematic showing a change of cylinder modes from six cylinders to three cylinders and back to six cylinders.

As shown in FIG. 13, a delay can also be instituted in a changeover from a mode of more operating cylinders to a mode of fewer operating cylinders. As previously stated, this is called a kick-in delay. The kick-in delay time is not as extensive as the kick out delay time. Because when there is a shift from a greater cylinder mode (where there is less noise needing cancellation) to a lesser cylinder mode (where there is more noise needing cancellation), not having the ANC operating in the mode of less cylinders risks not cancelling louder noise. This small delay however prevents causing instability in the ANC system which is possible if the cylinder mode changes from a greater cylinder mode to a lesser cylinder mode and back to a greater cylinder mode very quickly.

FIG. 13 first shows a mode change from a six cylinder operating mode to a three or four cylinder operating mode. A very small kick-in delay time (2 msec) is used so there little chance for the $1.5^{th}$ order signal to avoid cancellation. FIG. 13 shows utilization of a waiting time period before the $1.5^{th}$ order signal begins. The waiting time period is 55 ms. However, use of the waiting time period is not necessary here and is only implemented for simplicity (if the device used for providing waiting time is not adjustable). Otherwise, waiting time is not used when changing from a more numerous cylinder operating mode to a less numerous operating mode.

FIG. 13 then shows use of both delay time and waiting time when changing the operating mode back to a six cylinder operating mode.

Alternatives

FIG. 12 shows a parabolic declining trace of the $1.5^{th}$ order cancellation signal during the waiting time period. The declining trace may alternatively be linear. Similarly the increasing trace of the $3^{rd}$ order signal that occurs after the waiting time period may be parabolic or another non-linear shape. The shape depends on the type of electronic hardware being used in the vehicle's ANC system.

The invention has been described for use with a six cylinder vehicle engine, but may be used with any size vehicle engine on which Cylinder De-activation may be practiced.

The present invention provides an advantage over current practice because residual exhaust-based noises, which are not currently cancelled are now cancelled. This cancellation makes for a more enjoyable ride for the vehicle passengers.

Although the invention has been shown and described with reference to certain preferred and alternate embodiments, the invention is not limited to these specific embodiments. Minor variations and insubstantial differences in the various combinations of materials and methods of application may occur to those of ordinary skill in the art while remaining within the scope of the invention as claimed and equivalents.

What is claimed is:

1. A method for reducing noise in a passenger cabin, within a vehicle that performs engine cylinder de-activation and re-activation, comprising the steps of:

providing a controllable engine that utilizes a different number of engine cylinders in first and second operating modes;

providing a noise cancellation system that cancels engine noise generated at a first frequency indicative of the number of active cylinders in the first engine operating mode, the cancellation system using a cancellation sound also at about the first frequency;

changing from the first engine operating mode to the second operating mode;

extending the provision of the noise cancellation sound at about the first frequency beyond the time when first operating mode is changed to the second operating mode, whereby a residual exhaust-related noise in the first frequency that would be heard in the cabin after the operating mode change occurs is cancelled.

2. The method of claim 1, wherein in the first operating mode three cylinders are utilized and in the second operating mode six cylinders are utilized.

3. The method of claim 1, comprising the additional steps of stopping the provision of noise cancellation sound at about the first frequency and of providing a second noise cancellation sound, during the second operating mode, that cancels engine noise generated at a second frequency indicative of the number of active cylinders in the second engine operating mode, the second cancellation sound also at about the second frequency.

4. The method of claim 3, comprising the additional step of waiting to begin providing the second noise cancellation sound for a fixed time after stopping the cancellation of noise at about the first frequency.

5. The method of claim 1, wherein the extension of the provision of the noise cancellation sound at about the first frequency is for about 125 microseconds.

6. The method of claim 1, wherein the noise cancellation system provides an initial feed-forward cancellation signal based on the rotation of the engine output shaft and adjusts the signal in a feedback manner based on noise heard on microphones in the vehicle cabin.

7. The method of claim 6, wherein in the vehicle cabin the cancellation sound is output via door speakers and a rear subwoofer.

8. The method of claim 3, further including the steps of changing from the second engine operating mode back to the first operating mode;

extending the provision of the noise cancellation sound at about the second frequency beyond the time when second operating mode is changed to the first operating mode.

9. A vehicle comprising:

a controllable engine that utilizes a different number of engine cylinders in first and second operating modes;

a noise cancellation system that cancels engine noise generated at a first frequency indicative of the number of active cylinders in the first engine operating mode, the cancellation system using a cancellation sound also at about the first frequency;

wherein the noise cancellation system also extends the provision of the noise cancellation sound at about the first frequency beyond the time when first operating mode is changed to the second operating mode, whereby a residual exhaust-related noise in the first frequency that would be heard in the cabin after the operating mode change occurs is cancelled.

10. The vehicle of claim 9, wherein in the first operating mode three cylinders are utilized and in the second operating mode six cylinders are utilized.

11. The vehicle of claim 9, wherein the noise cancellation system stops the provision of noise cancellation sound at about the first frequency, and provides a second noise cancellation sound, during the second operating mode, that cancels engine noise generated at a second frequency indicative of the number of active cylinders in the second engine operating mode, the second cancellation sound also at about the second frequency.

12. The vehicle of claim 9, wherein the extension of the provision of the noise cancellation sound at about the first frequency is for about 125 microseconds.

13. The vehicle of claim 9, wherein the noise cancellation system provides an initial feed-forward cancellation signal based on the rotation of the engine output shaft and adjusts the signal in a feedback manner based on noise heard on microphones in the vehicle cabin.

14. The method of claim 9, wherein in the vehicle cabin the cancellation sound is output via door speakers and a rear subwoofer.

* * * * *